US006681700B1

(12) United States Patent
Capewell et al.

(10) Patent No.: US 6,681,700 B1
(45) Date of Patent: Jan. 27, 2004

(54) CAPACITIVE FUSES FOR MISSILES

(75) Inventors: William Kenneth Capewell, Maidstone (GB); Edward David Lawrence, Maidstone (GB); Robin John Davies, Nr. Maidstone (GB)

(73) Assignee: Alenia Marconi Systems Limited, Chelmsford (GB)

( * ) Notice: Subject to any disclaimer, the term of this patent is extended or adjusted under 35 U.S.C. 154(b) by 0 days.

(21) Appl. No.: 05/064,156

(22) Filed: Jul. 31, 1970

(51) Int. Cl.[7] ..... F42C 13/00
(52) U.S. Cl. ..... 102/211
(58) Field of Search ..... 102/70.2, 70.2 F, 102/211, 214

(56) References Cited

U.S. PATENT DOCUMENTS 2,931,300 A * 4/1960 Lovd et al. ..... 102/70.2 P
3,131,388 A * 4/1964 Baker ..... 102/70.2 P
3,143,072 A * 8/1964 Dell et al. ..... 102/70.2 P
3,326,130 A * 6/1967 Baker ..... 102/70.2 P

* cited by examiner

*Primary Examiner*—Charles T. Jordan
(74) *Attorney, Agent, or Firm*—Kirschstein, et al.

(57) ABSTRACT

In a capacitive fuse for a missile interference due to discharge of static electricity from transmitter or receiver electrodes or to movement of the missile's control surfaces in flight is reduced by using as a receiver input signal the difference between signals at a pair of like receiver electrodes. The receiver includes a phase detector, and a small proportion of the transmitted signal is passed to the receiver input to cancel any standing receiver current. The output from two or more sets of receiver electrodes may be combined to produce s desired response pattern.

4 Claims, 4 Drawing Sheets

CAPACITIVE FUSES FOR MISSILES

The present invention relates to capacitive fuses for missiles.

In previously known capacitive fuses the sensitivity obtainable has been severely limited by interference from sources such as corona discharge of the self capacitance of the missile body, which body becomes charged during passage of the missile through the atmosphere, from vibration of the missile body and from movements of the missile control surfaces.

It is an object of the present invention to provide a capacitive fuse in which the effects of such interference are reduced.

According to a first aspect of the present invention in a capacitive fuse for a missile there are provided a source of alternating current signals a transmitter electrode, two receiver electrodes and means to derive a signal dependent upon the difference between alternating signal currents received from said transmitter electrode by said receiver electrodes, the size and disposition of said receiver electrodes being arranged substantially to minimise interference in said difference current.

According to a second aspect of the present invention in a capacitive fuse for a missile comprising a source of alternating current signals, a transmitter and one or more receiver electrodes and means responsive to components of said alternating current signals passing byway of said transmitter and receiver electrodes, a phase sensitive detector is arranged to derive the signal passed to said means in dependence upon the signal currents flowing into said one or more receiver electrodes whereby the effective level of components not synchronous with said alternating current signal is reduced.

According to a third aspect of the present invention in a capacitive fuse for a missile comprising a source of alternating current signals, a transmitter and one or more receiver electrodes and means responsive to components of said alternating current signals received at said receiver electrodes, there is provided control means to apply alternating current signals from said source to said first mentioned means substantially in antiphase to alternating current signals from said source reaching said first mentioned means by capacitive coupling between said transmitter and receiver electrodes, whereby the effects of unwanted components in the signals from said source may be substantially reduced at the input to said first mentioned means.

Preferably the control means is such that the amplitude of alternating current signals passed by said control means to the input of said first mentioned means is at least partially dependent upon an output signal from said first-mentioned means.

According to a fourth aspect of the present invention in a capacitive fuse for a missile there are provided a source of alternating current signals, a transmitter electrode, at least two differing receiver electrode assemblies, and means to compare signals received by way of said two receiver electrode assemblies and to provide an output substantially only when the signals received by way of the two receiver electrode assemblies are of predetermined relative amplitudes.

Preferably said receiver electrode assemblies comprise respectively one and two receiver electrodes.

A capacitive fuse for a missile will now be described with reference to the accompanying drawings, of which:

Figure 1:
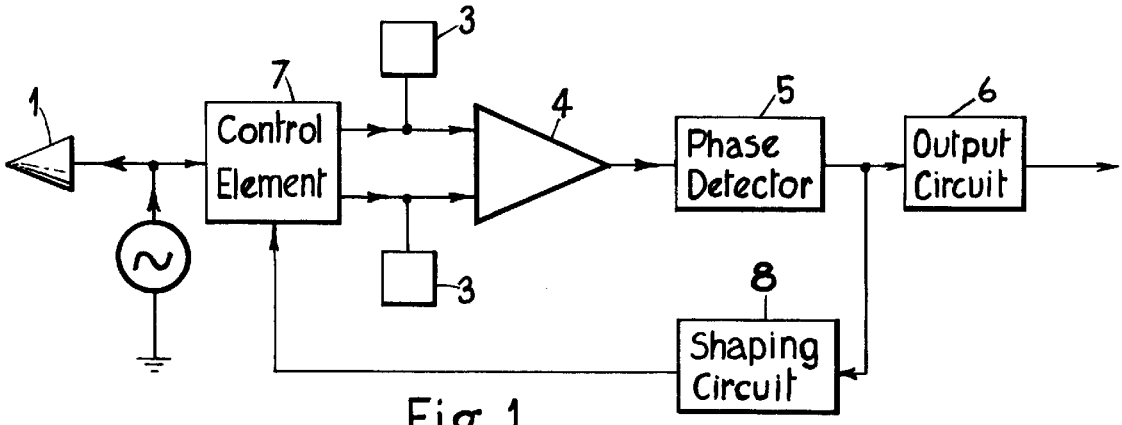
FIG. 1 shows diagrammatically a part of the fuse.

Referring first to FIG. 1 the fuse comprises a transmitter electrode 1, to which is connected a source of oscillatory signals 2, and a pair of receiver electrodes 3 which are connected to differencing inputs of an amplifier 4. The output of the amplifier 4 is applied to a detector 5 where it is compared in phase with a reference signal from the oscillator 2, and the output of this detector 5 is connected to an output circuit 6, which may function for example to trigger a warhead detonator (not shown) in response to conditions of coupling between the transmitter and receiver electrodes 1 and 3 respectively which indicate the proximity of a target.

In order to cancel unwanted components of the signals received by the receiver electrodes 3 from the transmitter electrode 1 balancing signals in antiphase to those normally received by the receiver electrodes 3 are applied by way of a control element 7 to the respective inputs of the amplifier 4, the amplitude of these balancing signals being determined by the value of the output signal of a shaping circuit 8 which in turn is connected to receive an output signal from the detector 5.

Figure 2:
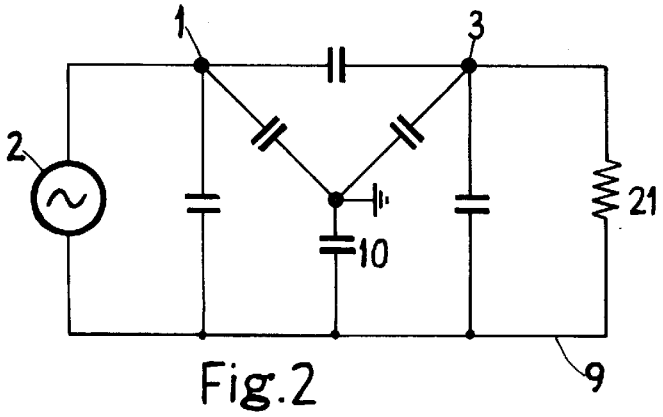
FIG. 2 shows schematically an electrical equivalent circuit of a part of the fuse.

Referring now to FIG. 2 the transmitter electrode 1, each of the receiver electrodes 3 and the body of the missile represented by the line 9 have self capacitances and mutual capacitances as indicated. In flight the body of the missile slowly acquires an electric charge due to its passage through the air, that is the self capacitance 10 of the body 9 slowly becomes charged. At random instants some or all of the acquired charge may be removed by corona discharge, giving rise to short voltage pulses which are passed to the input to the amplifier 4, represented by the resistor 21. These pulses may be of sufficient amplitude to seriously limit the sensitivity of the system, in that the receiver must be arranged not to respond to such pulses.

Figure 3:
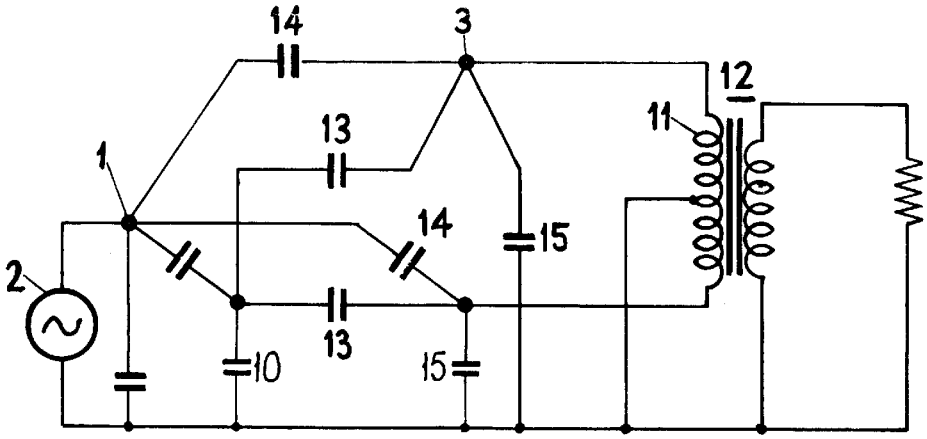
FIG. 3 shows schematically a further electrical equivalent circuit of a part of the fuse.

Referring sow to FIG. 3, where two receiver electrodes 3 are provided as in FIG. 1, they are connected to respective inputs of the amplifier 4 such that the difference between the two received signals Is obtained. The differencing arrangement is represented in FIG. 3 by the centre-tapped primary winding 11 of the transformer 12. It will be seen that by choosing appropriate values for the self capacitances 13 of the receiver electrodes 3, the transmitter to receiver electrode capacitances 14 and the receiver electrode to missile body capacitances 15 the effects of the voltage pulses due to corona discharge of the missile body capacitance 10 can be arranged substantially to balance out in the two halves of the winding 11.

A particular example of such appropriate values would be where the two capacitances 13 were equal, tie two capacitances 14 were equal and the two capacitances 15 were equal.

Although interference from corona discharge may be reduced by using a balanced pair of receiver electrodes 3 as described above, in general some interference will still remain at the input to the detector 5. By using a phase sensitive detector the effects of random interference may be reduced still further, as illustrated in FIGS. 4 and 5.

Figure 4:
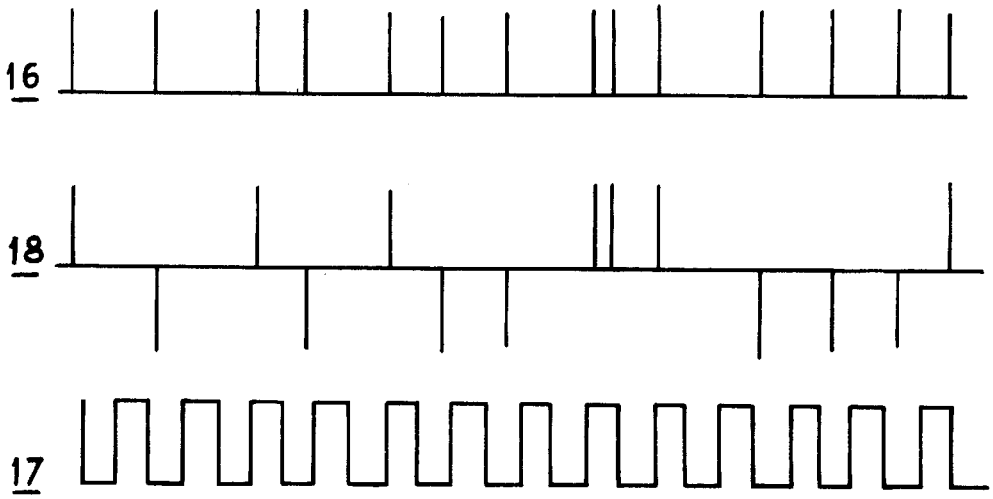
FIGS. 4 and 5 show electrical waveforms used to illustrate the operation of the fuse.

In FIG. 4 there is shown under reference 16 a random succession of interference pulses which are all of relatively short duration compared with the reference demodulating waveform 17 (shown for convenience as a square wave). The interference pulses are all of the same polarity since they are all considered to result from the same cause, that is, the discharge of the missile body capacitance 10. The effect of the phase sensitive detector is to invert some of these interference pulses, as shown at 18, and in this form the interference pulses may be greatly attenuated by inserting a low-pass filter in the output path of the detector 5.

Figure 5:
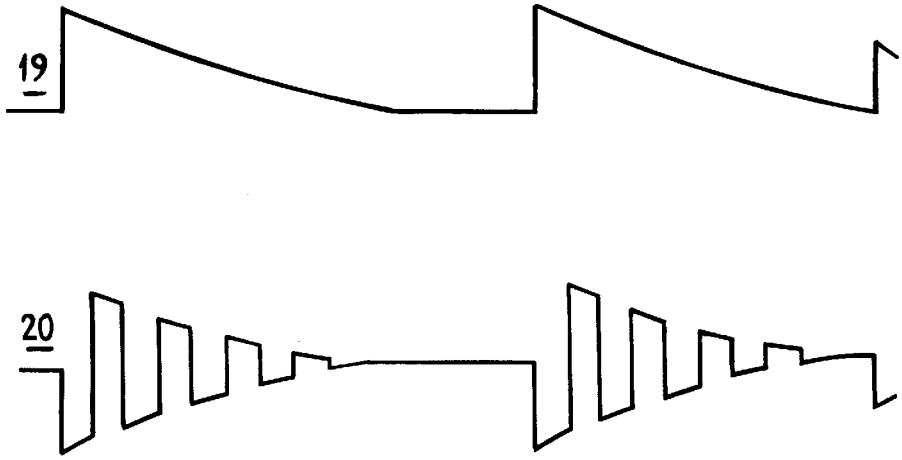

In FIG. 5 is shown a random succession 19 of interference pulses of relatively long duration relative to the period of the reference waveform 17. The output of the detector 5 in this case comprises a succession of pulses of alternate polarity as shown at 20, and once again the insertion of a low-pass filter in the output path of the detector 5 will reduce the effective level of the interfering signals.

The use of the phase sensitive detector 5 followed by a low-pass filter enables a broad band amplifier to be used as the amplifier 4 rather than a harrow band amplifier the tuned circuits of which are prone to shock excitation by interference pulses.

In order to overcome interference sad unbalance arising in ways other than the corona discharge of the missile body, for example from transmitter microphony, missile flexure or from control surface movements, a portion of the transmitter signal is fed by way of the control element 7 to the inputs of the amplifier 4 in antiphase to the normal receiver electrode standing signals. This reduces the effects of transmitter microphony by an amount dependent upon the degree of balance achieved. At the same time the portion of the transmitter signal passed by the control element 7 is varied by the shaping circuit 8 in dependence upon the output signal of the detector 5. The characteristics of the shaping circuit 8 are chosen such that signals varying at a higher or lower rate than the expected rate due to the approach of a target are effectively cancelled by the signals passed by the control element 7, while little attenuation of target signals occurs.

Due to the provision of this retroactive loop any direct current unbalance in the output of the detector 5 will be cancelled out, go that the precision with which the transmitter and receiver electrodes are constructed and positioned need not be influenced by considerations of receiver saturation. In addition the loop greatly reduces the effects of interference at frequencies different than that expected from the target. The positions of the receiver electrodes 3 can therefore be chosen such that interfering effects at frequencies within the target response bead can be cancelled out.

Figure 6:
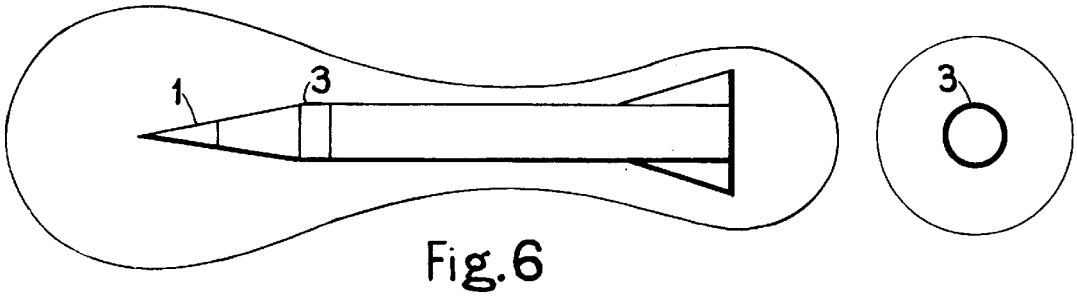
FIGS. 6 to 8 show response patterns of different forms of the fuse, FIG. 9 which shows parts of FIG. 1 in greater detail.
Figure 7:
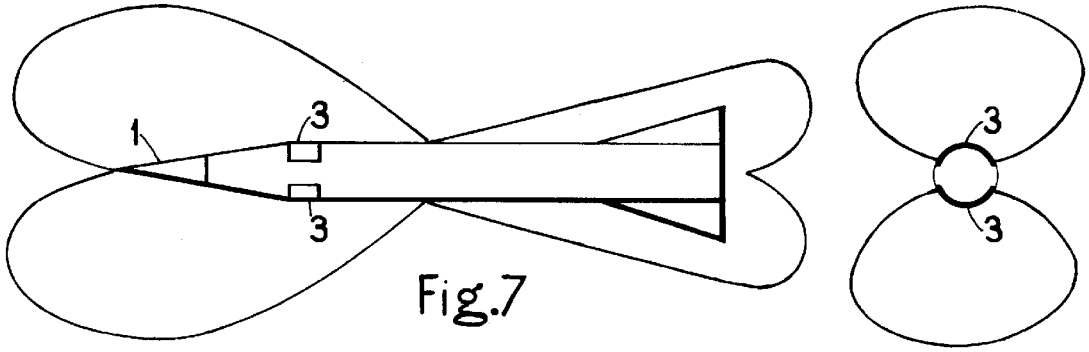
Figure 8:
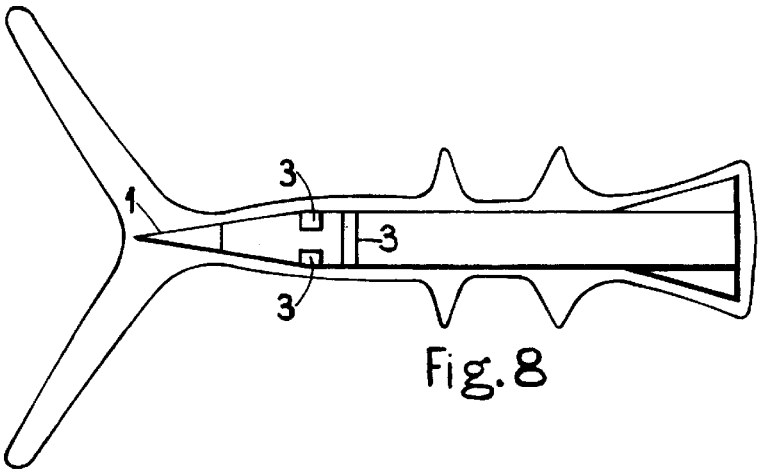

Referring now to FIGS. 6 to 8, the response pattern of the fuse for a single transmitter electrode 1 positioned at the nose of the missile and a single annular receiver electrode 3 spaced some way towards the tail of the missile is as shown in FIG. 6. Where the receiver electrode is divided into two part annular electrodes the response pattern is as shown in FIG. 7, the response in the roll plane being lobed rather than circular as in the case shown in FIG. 6.

If three receiver electrodes 3 are provided, a pair of these being part annular and the third being annular, as indicated in FIG. 8, the response pattern outlined in FIG. 8 may be obtained by comparing the output signals from the pair of receiver electrodes 3 end the annular receiver electrode 3 respectively and taking an output signal only if the two signals are of comparable magnitude. By altering the relative ratio of the two signals required to give an output the angle of the main lobes with respect to the axis of the missile may be varied. Other multiple receiver electrode arrangements may be used to give desired response patterns.

Figure 9:
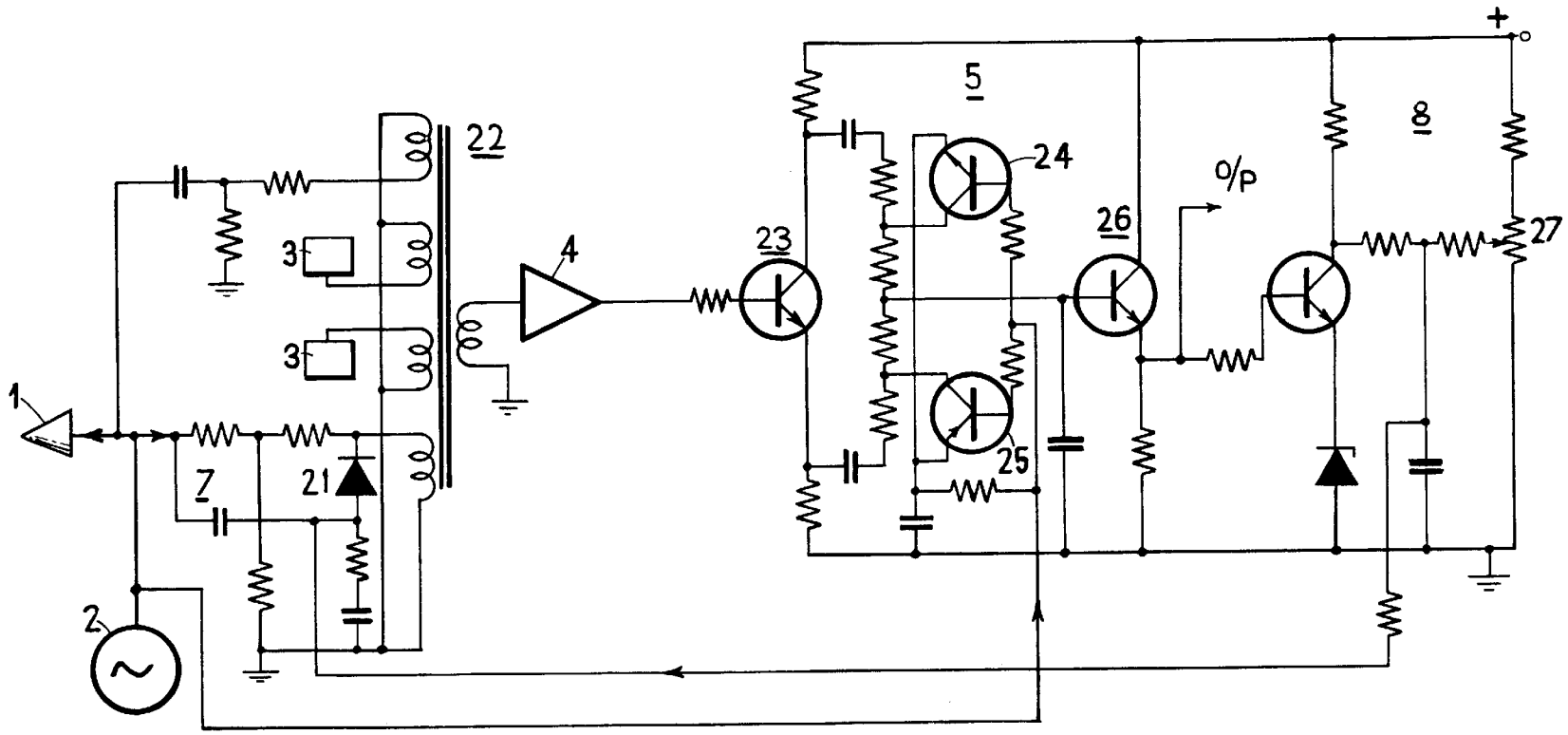

Referring now to FIG. 9 the control element comprises a diode 21 which is connected in shunt with a resistive path from the output of the oscillator 2 to a winding of the input transformer 22 of the amplifier 4.

The output of the amplifier 4 is applied to a phase splitter stage 23 which in turn feeds a phase detector stage comprising transistors 24 and 25 of opposite conductivity type. Output signals are derived by way of an emitter-follower buffer stage 26, and these signals are passed to an output circuit 6 (FIG. 1) and to the shaping circuit 8, the latter circuit providing a forward bias for the diode 21 of a value dependent upon the value of the output signal from the buffer stage 26 and upon the setting of a potentiometer 27.

A small signal of substantially constant amplitude is applied to a winding of the transformer 22 from the oscillator 2 by way of a network 28 in antiphase to the signal applied by way of the control element, which is of controlled amplitude.

We claim:

1. A capacitive missile fuze arrangement comprising an elongated missile body that is of generally circular cross-section, a source of alternating current signals within said body, said source having an output, a transmitter electrode mounted on said body, means connecting said output of said source of alternating current signals to said transmitter electrode, a pair of receiver electrodes of substantially equal size mounted substantially symmetrically about the longitudinal axis of said body, differencing circuit means having a pair of inputs, means connecting said receiver electrodes to respective inputs of said differencing circuit means, and output circuit means responsive to the output of said differencing circuit means.

2. A capacitive missile fuze arrangement in accordance with claim wherein said output circuit means includes a phase sensitive detector connected to the output of said differencing circuit means, and an output from said alternating current source is connected to a reference input of said phase sensitive detector.

3. A capacitive missile fuze arrangement in accordance with claim wherein there is provided a third receiver electrode axially displaced along said missile body with respect to said pair of receiver electrodes, and said output circuit means includes means for comparing the output of said pair of electrodes with the output of said third electrode.

4. A capacitive missile fuze arrangement in accordance with claim 1 wherein each of said receiver electrodes is of partly cylindrical shape and each forms part of the surface of the missile body.

* * * * *